US006463620B2

(12) United States Patent
Busha

(10) Patent No.: US 6,463,620 B2
(45) Date of Patent: Oct. 15, 2002

(54) BRUSH ASSEMBLY WITH REMOVABLE/ DISPOSABLE HEAD

(76) Inventor: Kandice A. Busha, 2944 Bent Creek La., Kennesaw, GA (US) 30152

( * ) Notice: Subject to any disclaimer, the term of this patent is extended or adjusted under 35 U.S.C. 154(b) by 10 days.

(21) Appl. No.: 09/798,043

(22) Filed: Mar. 5, 2001

(65) Prior Publication Data

US 2002/0120993 A1 Sep. 5, 2002

(51) Int. Cl.[7] ..... A47K 11/10
(52) U.S. Cl. ..... 15/176.6; 15/114; 15/210.1
(58) Field of Search ..... 15/114, 176.1, 15/176.6, 160, 289.1, 210.1

(56) References Cited

U.S. PATENT DOCUMENTS 4,031,673 A * 6/1977 Hagelberg
4,194,852 A 3/1980 Cupp et al.
4,457,038 A 7/1984 Hammond
5,010,615 A 4/1991 Carter
5,630,243 A * 5/1997 Federico
5,875,512 A * 3/1999 Lathan
5,878,459 A * 3/1999 McParland
6,029,307 A 2/2000 Baudoin
D425,308 S 5/2000 Ancona et al.
6,269,516 B1 * 8/2001 Saatjian
6,272,716 B1 * 8/2001 Thornton

* cited by examiner

*Primary Examiner*—Terrence R. Till
(74) *Attorney, Agent, or Firm*—William B. Noll

(57) ABSTRACT

A brush assembly, such as for cleaning and sanitizing toilet bowls, having a removable and disposable applicator head. The brush assembly comprises an elongated handle with a broadening diverging end and an applicator head for removable attachment thereto. Dual locking means for the applicator head are provided, where the locking means may be manually released without having to physically handle a soiled applicator head.

9 Claims, 2 Drawing Sheets

10
12
32
24
34
30
20
18
14
16
48
44
58
46
42
36
26
28
22
15
38
40

32
34
42
30
40
56
48
58
54
52
50
62
60
46
44
64

BRUSH ASSEMBLY WITH REMOVABLE/ DISPOSABLE HEAD

FIELD OF THE INVENTION

This invention is directed to the field of brush assemblies, more particularly to a brush assembly having a removable and disposable brush head that has a preferred use as a toilet bowl brush.

BACKGROUND OF THE INVENTION

The present invention, in a preferred embodiment, relates to a toilet bowl brush assembly that has a removable and disposable head. Toilet brushes normally comprise plastic or wooden handles to which a brush or mop head is rigidly and permanently secured. When such brushes are worn, they must be replaced, and if the cleaning operation is a commercial establishment, frequent replacement can be expensive. Over and above the replacement issue, what may be more significant is the fact that such brushes are used in an environment that fosters germ growth. Traditionally, after use, the brushes are set aside in a portable cradle or merely placed in a closet. While such brushes offer a convenient place for spawning germ growth, the odors may also be offensive.

Disposable brushes have become known, but cost remains a concern for their broad use. The prior art offers a number of brush assemblies which include throw away brush heads. Certain of this prior art is reflected in the following U.S. Patents:

a.) U.S. Pat. No. 6,029,307, to Baudoin, teaches a kit for aiding in the drying and curling of hair. The kit includes plurality of brushes which may be twisted into the hair and allowed to remain for a period of time to set a curl. Each of the brushes has a connector to which a handle can be removably attached such that a single handle can be used with all of the brushes in the kit.

b.) U.S. Pat. No. 5,010,615, to Carter, relates to a hand-holdable tool including a handle that is detachably connected to a head unit by a locking and release mechanism that has a snap lock on the handle and a snap lock receiver located interiorly of the head unit. A soap impregnated cleaning pad of special steel can be attached to the head unit.

c.) U.S. Pat. No. 4,457,038, to Hammond, describes a permanent handle for a disposable brush or mop head. The handle comprises an elongated hollow body having a bottom and top end, the bottom end to releasably and frictionally engage a disposable brush or mop head and secure it in working position on the handle body. When it is desired to change the head, a plunger longitudinally movable within the elongated body is manipulated by the user to bear against a portion of the brush or mop head and dislodge it from frictional engagement with the body. In this manner the operator can avoid touching a soiled brush or mop head when removing it from the handle for replacement.

d.) U.S. Pat. No. 4,194,852, to Cupp et al., teaches an applicator for applying a liquid coating to a suitable object that includes a pad and a detachable handle. The pad includes a cushion, working means applied to the cushion lower surface, and a backing plate secured to the cushion upper surface. The plate is provided with hooks extending upwardly from its upper surface, and each hook is arranged along one of three sides of an imaginary square so as to capture an object slidably inserted into this imaginary square from the fourth side thereof The handle has, adjacent one end, an outturned square perimetrical flange which is adapted to be inserted into engagement with the hooks at any of four angular positions. The applicator may further include an adapter arranged to be inserted into the open end of the tube-like handle, to modify the same to matingly receive the threaded end portion of an extension pole.

The prior art enumerated above are several examples that offer a brush like member having a removable head for one reason or another. None, however, present a sanitary device that is suitable for cleaning toilet bowls, while including, among other features, means to release the used head without the user having to handle the brush head. The manner by which the present invention achieves the goals hereof will become more apparent in the description which follows, particularly when read in conjunction with the accompanying drawings.

SUMMARY OF THE INVENTION

This invention is directed to a low cost and convenient means for cleaning and sanitizing a toilet bowl, for example, more particularly a brush assembly that includes a removable brush head that may be thrown away without requiring the user to handle the brush head. The assembly comprises a hand held tool having an elongated, hand gripping handle, terminating in a diverging end for removably receiving a concave housing member mounting brushing and scrubbing elements on its exterior, and a cam receiving opening on the opposite surface. To partially secure the concave housing member to the diverging end, the housing member includes a male tab for sliding engagement to a complementary female slot in the front face of the diverging end. The elongated handle is further characterized by a channel extending from a midpoint along the exterior through the interior terminating within the diverging end. Within the channel is a spring loaded rod mounting a cam member at its free end, where said cam member is sized to engage said cam receiving opening. In a first mode the cam member and complementary opening provide means to maintain the engagement of the housing member to the diverging end. However, when turned about 90° by a manual knob at the other end of the rod, designating a second mode, the cam member becomes aligned with the complementary opening such that the cam member may be released therefrom. Once released, it is a simple matter to slide the housing member relative to the diverging end to free the housing member for easy disposal.

Accordingly, an object of the invention is a sanitary household device for cleaning toilet bowls, where the device incorporates a manually operable locking mechanism for releasing a throw away brushing element.

Another object hereof is the provision of secondary, cooperating locking members to secure the throw away brushing element to the handle of the device.

A further object of the invention is the provision of a throw away brushing element that may incorporate plural brushing elements, such as bristles and a scrubbing pad.

Still another object hereof is a throw away brushing element comprising a concave housing having a cam receiving opening forming a part of the locking mechanism.

These and other objects will become clearer from the description and supporting drawings which follow.

DETAILED DESCRIPTION OF PREFERRED EMBODIMENT

Figures 1, 2, 4:
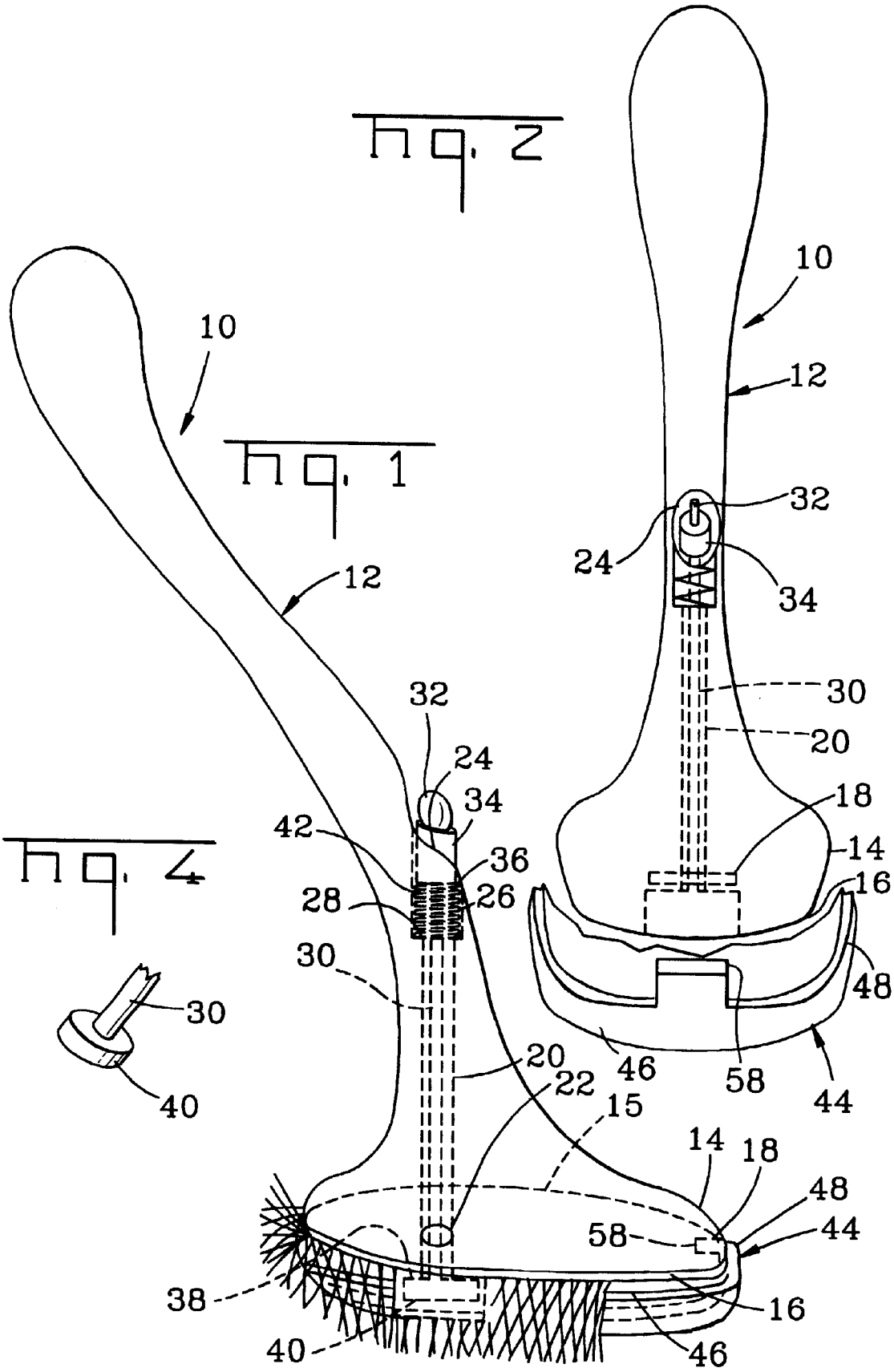
FIG. 1 is a side view of the brush assembly of this invention.
FIG. 2 is a front view of the brush assembly hereof, partially showing the disposable brush housing, less the scrubbing pad, exploded from the handle.
FIG. 4 is a perspective view of the cam lock head for the mechanism of FIG. 3.

The present invention relates to a brush assembly, with a removable and disposable head, that has particular utility as a hand held brushing device for cleaning and sanitizing toilet bowls. The brush assembly will now be described with regard to the several Figures where like reference numerals represent like components or features throughout the various views.

The full brush assembly 10 is illustrated in FIGS. 1 and 2. The assembly comprises an elongated, generally solid, arcuate shaped handle portion 12 terminating in a diverging end 14, a base 15, and peripheral rim 16. Adjacent the rim 16, at the front, is a horizontal slot 18, the function of which will become clear hereafter. Internally, the handle portion 12 features a through channel 20 extending from the base 15, and communicating therewith through opening 22, vertically to an external opening 24. The opening 24 is further characterized by a broadened concentric recess 26 that is defined by an annular shoulder 28. Extending throughout the channel 20 is a sliding rod 30 that includes at a first or top end a knob 32 mounted to a rod extension 34, where the rod extension includes a lower, annular shoulder 36.

The sliding rod 30, at a second or lower end 38, features a half circled cam element 40 (FIG. 4), where vertical movement of the rod 20 is limited by the cam element 40 and rod extension 34. However, to temporarily fix the relationship of the rod to the channel a biasing coil spring 42 is provided within the broadened concentric recess 26, between the opposing shoulders 28, 36. To move the rod 20, the knob 32, against the action of the coil spring 42, is pushed downward and turned, as later explained. Upon release, the rod returns to the resiled position.

The removable and disposable portion of the brush assembly 10 is the housing portion 44 containing the bristle and scrubbing elements, as later described. The housing portion 44, best seen in FIG. 3, comprises a cup or concave shaped plastic support 46 having a peripheral rim 48 that essentially coincides with the peripheral rim 16 of the diverging end 14. Internally the housing portion 44 includes an upright chamber 50 defined by plural walls 52 and a top wall 54 featuring an opening 56 shaped to sidably receive the cam element 40 in a first operating mode. Note in particularly FIG. 3 where the cam element 40 is oriented to be freely received into the opening 56. However, once the cam element is so engaged, turning of the rod 30 will effect a mutual locking of the cam element within the chamber 50 with the misalignment of the cam element 40 to the opening 46. This will be discussed in more detail later.

Figure 3:
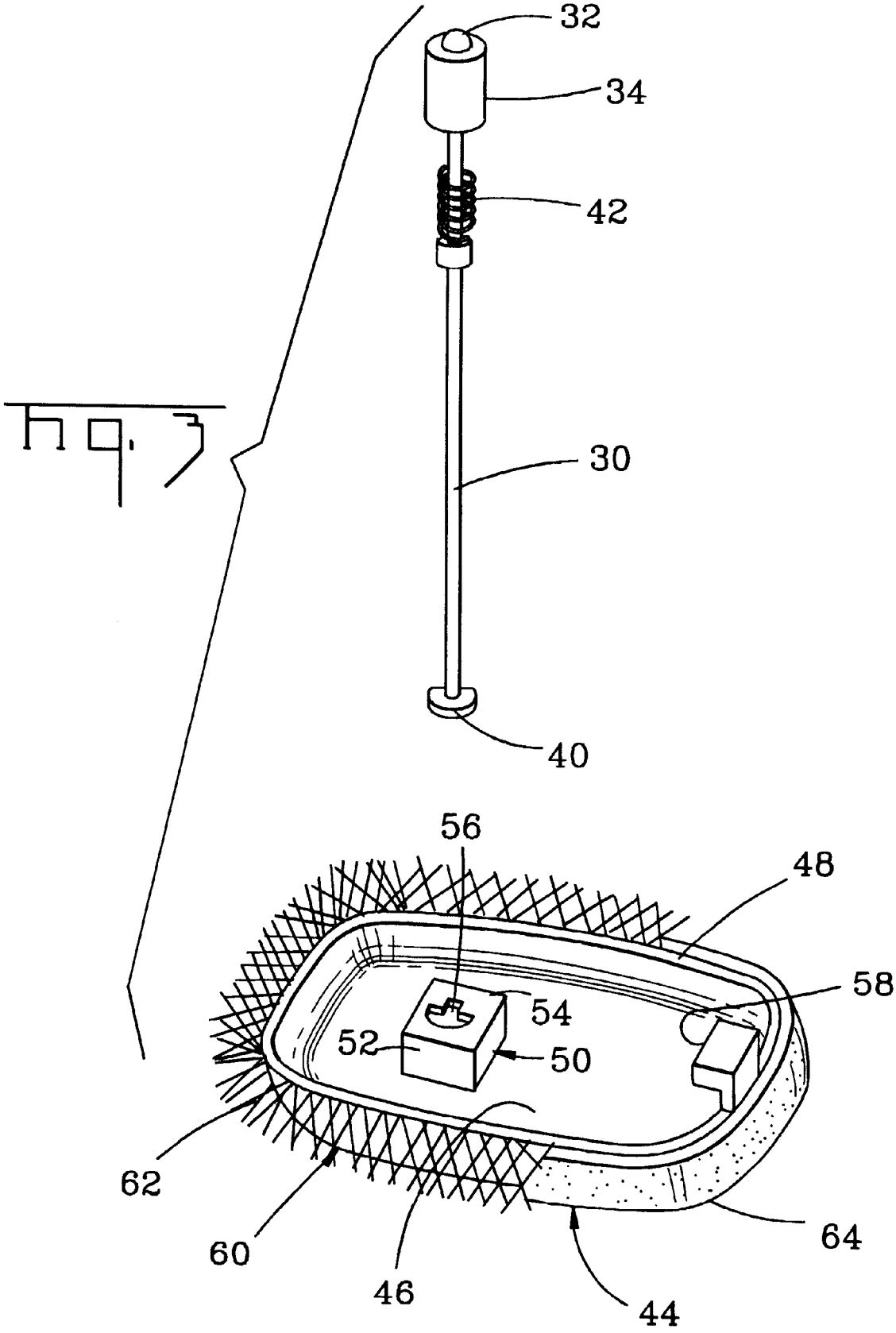
FIG. 3 is a top, exploded perspective view of the disposable brush housing and spring loaded release mechanism for the assembly according to this invention.

Along the front of the peripheral rim 48 is an upwardly and inwardly extending male tab 58 for slidably engaging the slot 18 in the diverging end 14, see FIGS. 2 and 3. It is the combination of these engaging elements 58, 18 and the cam element 40 within the chamber 50 that ensures a temporary integral unit for the cleaning and scrubbing operation. However, to replace a new housing portion, the rod 30, by pushing on the knob 32 against the coil spring 42, pushes the cam element 40 further into the chamber 50 and then turned about 900 to align the shaped cam element to the opening 56 to allow the housing portion 44 to be released therefrom. By simply shifting the housing portion forward, the male tab 58 is finally released from the female slot 18 to fully release the housing portion from the diverging end of the handle. By this simple arrangement the germ laden housing portion 44, with its scrubbing elements, may be properly disposed of without having to handle the housing portion. With the housing portion free of the assembly 10, a fresh housing portion 44 may be secured thereto by engaging the tab and slot followed by securing the cam element into the chamber 50 and turning the rod 30. Upon releasing the rod, the energy of the coil spring raises the rod to its resiled position to temporarily secure the housing portion to the diverging end for continued use.

A preferred housing portion, best illustrated in FIGS. 1 and 3, shows the scrubbing elements 60 to consist of a bristle portion 62 in combination with pad 64 to ensure a full and proper cleaning of the bowl surfaces. As clearly seen in the two Figures, the scrubbing elements 60 are secured to the outer or concave surface of the housing portion.

It is recognized that changes, variations and modifications, particularly by those skilled in the art, may be made to the brush assembly of this invention, without departing from the spirit and scope thereof. Accordingly, no limitation is intended to be imposed thereon except as set forth in the accompanying claims.

I claim:

1. A brush assembly having a removable and disposable application head, said brush assembly comprising:

a.) an elongated handle having a hand gripping end and a broadening diverging end featuring a base wall surrounded by a peripheral rim, a through channel extending between said base wall and the exterior of said elongated handle, a spring biased, elongated rod within said channel, where said rod is vertically movable in said channel, a cam element mounted on one end of said rod in proximity to said base wall, and a slot adjacent said peripheral rim in said diverging end; and, b.) a removable and disposable application head comprising a cup shaped base having a concave face and a peripheral rim sized to lie contiguous with the peripheral rim of said diverging end, a recess chamber mounted on the concave face thereof, where said recess chamber includes an opening when aligned to slidably receive said cam element in a first orientation, and misaligned in a second orientation, an upwardly and inwardly directed tab along said peripheral rim of said cup shaped base sized to slidable engage said slot, and scrubbing elements on the convex surface of said cup shaped base.

2. The brush assembly according to claim 1, wherein said cam element is essentially a semi-circle, and said opening is comparably shaped.

3. The brush assembly according to claim 2, wherein said application head and said diverging end are intimately locked in said second orientation.

4. The brush assembly according to claim 3, including a coil spring operating on said elongated rod to assist in holding said rod and said cam element in said second orientation.

5. The brush assembly according to claim 1, wherein said scrubbing elements consist of a first portion containing bristles, and a second portion containing a pad.

6. The brush assembly according to claim 1, wherein said elongated rod includes an exposed knob for manually pushing and turning said rod to effect releasing and locking said application head.

7. The brush assembly according to claim 6, wherein said channel includes an expanded concentric portion adjacent said exterior, and a movable knob extension within said concentric portion.

8. The brush assembly according to claim , including a coil spring biasing said movable knob extension within said concentric portion.

9. The brush assembly according to claim 1, wherein said recess chamber comprises plural walls and a top wall, where said top wall contains said opening.

* * * * *